US010156382B2

(12) United States Patent
Passerell

(10) Patent No.: US 10,156,382 B2
(45) Date of Patent: Dec. 18, 2018

(54) HEAT TRAP

(71) Applicant: Steven Passerell, Ashtabula, OH (US)

(72) Inventor: Steven Passerell, Ashtabula, OH (US)

( * ) Notice: Subject to any disclaimer, the term of this patent is extended or adjusted under 35 U.S.C. 154(b) by 47 days.

(21) Appl. No.: 15/363,078

(22) Filed: Nov. 29, 2016

(65) Prior Publication Data

US 2018/0149389 A1 May 31, 2018

(51) Int. Cl.

| | |
|---|---|
| ***F16K 15/14*** | (2006.01) |
| ***F24H 9/12*** | (2006.01) |
| ***F24H 1/20*** | (2006.01) |
| ***F24H 9/20*** | (2006.01) |

(52) U.S. Cl.

CPC ..... *F24H 9/126* (2013.01); *F24H 1/205* (2013.01); *F24H 9/2035* (2013.01)

(58) Field of Classification Search

CPC F04B 39/1073; F04B 39/108; F04B 39/1033; F04B 39/1086; F04B 53/1037; F16K 15/144; F16K 15/10; F16K 17/18; F16K 15/16; B60K 15/03519

USPC ..... 122/14.31, 14.3, 19.2; 137/512.4, 855, 137/493.9

See application file for complete search history.

(56) References Cited

U.S. PATENT DOCUMENTS

| | | | | |
|---|---|---|---|---|
| 3,905,392 | A * | 9/1975 | Gray | F16K 15/148 137/512.4 |
| 4,083,583 | A * | 4/1978 | Volgstadt | C23F 13/02 285/136.1 |
| 6,745,723 | B1 | 6/2004 | Hicks et al. | |
| 7,270,087 | B2 | 9/2007 | Passerell et al. | |
| 2005/0263190 | A1* | 12/2005 | Hammond | F16K 15/035 137/512 |
| 2016/0245129 | A1* | 8/2016 | Fritsch | F01L 1/3442 |

* cited by examiner

*Primary Examiner* — Steven B McAllister
*Assistant Examiner* — Ko-Wei Lin
(74) *Attorney, Agent, or Firm* — Daniel M. Cohn; Howard M. Cohn

(57) ABSTRACT

An improved heat trap disposed in at least one of an inlet pipe and an outlet pipe for delivery of cold water into and hot water out of a water tank. The improved heat trap includes a tubular body and a seal element comprising first and second axially spaced flapper members which are adjoined by a spine. The seal element extends through the tubular body whereby the first and second flapper members form a seal against an interior surface of the tubular body to prevent the delivery of water through the tubular body.

10 Claims, 4 Drawing Sheets

HEAT TRAP

TECHNICAL FIELD OF THE INVENTION

The present invention relates generally to an improved heat trap. More specifically, to an improved heat trap disposed within a hot water heating system for preventing heat loss from the hot water in the hot water storage tank water to the cold water inlet piping and/or the hot water outlet piping to and from the hot water storage tank.

BACKGROUND OF THE INVENTION

Electric and gas water heaters are commonly used to provide a reserve of heated water for residential or commercial use. A typical water heater includes inlet piping for supplying cold water to a water tank and outlet piping for supplying heated water to one or more dispensing locations. Water heaters of both the fuel-fired and electrically heated types typically have a tank portion in which pressurized, heated water is stored for on-demand delivery to various types of hot water-utilizing plumbing fixtures such as, for example, sinks, bath tubs and dishwashers.

Heat loss and the associated reduction in energy efficiency is known to occur in water heater systems. During standby periods in which discharge of stored hot water from the tank is not required, it is desirable to substantially reduce heat loss from the stored hot water to cooler areas outside the tank. A significant portion of this heat loss occurs at the water heater inlet and outlet ports through which water is introduced into, and removed from, the water storage tank. Specifically, when water is neither being added to the water storage tank by means of the cold water inlet port nor removed from the water storage tank by means of the hot water outlet port, heat from the hot water from within the water storage tank tends to flow in the form of convection currents upward through the cold water inlet port and the hot water outlet port. Accordingly, these convection currents result in significant heat loss and reductions in water heater system energy efficiency.

SUMMARY OF THE INVENTION

According to an embodiment of the present invention, there is disclosed an improved heat trap disposed in at least one of an inlet pipe and an outlet pipe for delivery of cold water into and hot water out of a water tank. The improved heat trap includes a tubular body and a seal element comprising first and second axially spaced flapper members which are adjoined by a spine. The seal element extends through the tubular body whereby the first and second flapper members form a seal against an interior surface of the tubular body to prevent the delivery of water through the tubular body.

According to another embodiment of the present invention, there is disclosed a method of assembling an improved heat trap by securing a seal element to a tubular body. The method includes inserting a first generally curved outer portions of a first and second, axially spaced flapper members through two axially spaced horizontal slots of the tubular body. Then, disposing the first and second axially spaced flapper members at locations circumferentially spaced apart from one another within an internal cavity of the tubular body. The method then includes disposing a spine of the seal element within a vertical portion between the two axially spaced horizontal slots. Finally, placing first and second gussets within vertical slots of the tubular body whereby the first and second axially spaced, flapper members form a seal against an interior surface of the tubular body to prevent the delivery of water through the tubular body.

According to another embodiment of the present invention, there is disclosed a water heater system incorporating an improved heat trap disposed in at least one of an inlet pipe and outlet pipe for delivery of cold water into and hot water out of a water tank. The water heater system includes a water tank including first and second pipe nipples mounted to a top wall of the water tank. Inlet and outlet pipes are included for delivery of the cold water into and hot water out of the water tank mounted to the first and second pipe nipples, and an inlet tube is disposed within the water tank connecting at one end to the inlet pipe for delivery of cold water near to a bottom wall of the water tank. The heat trap is a tubular body disposed between the inlet pipe nipple and the inlet pipe, and a seal element, comprising first and second, axially spaced flapper members which are adjoined by a spine. The seal element extends through the tubular body whereby the first and second flapper members form a seal against an interior surface of the tubular body to prevent the delivery of water through the tubular body.

BRIEF DESCRIPTION OF THE DRAWINGS

The structure, operation, and advantages of the present invention will become further apparent upon consideration of the following description taken in conjunction with the accompanying figures (FIGs.). The figures are intended to be illustrative, not limiting. Certain elements in some of the figures may be omitted, or illustrated not-to-scale, for illustrative clarity. The cross-sectional views may be in the form of "slices", or "near-sighted" cross-sectional views, omitting certain background lines which would otherwise be visible in a "true" cross-sectional view, for illustrative clarity.

In the drawings accompanying the description that follows, both reference numerals and legends (labels, text descriptions) may be used to identify elements. If legends are provided, they are intended merely as an aid to the reader, and should not in any way be interpreted as limiting.

DETAILED DESCRIPTION OF THE PREFERRED EMBODIMENTS

Figure 1:
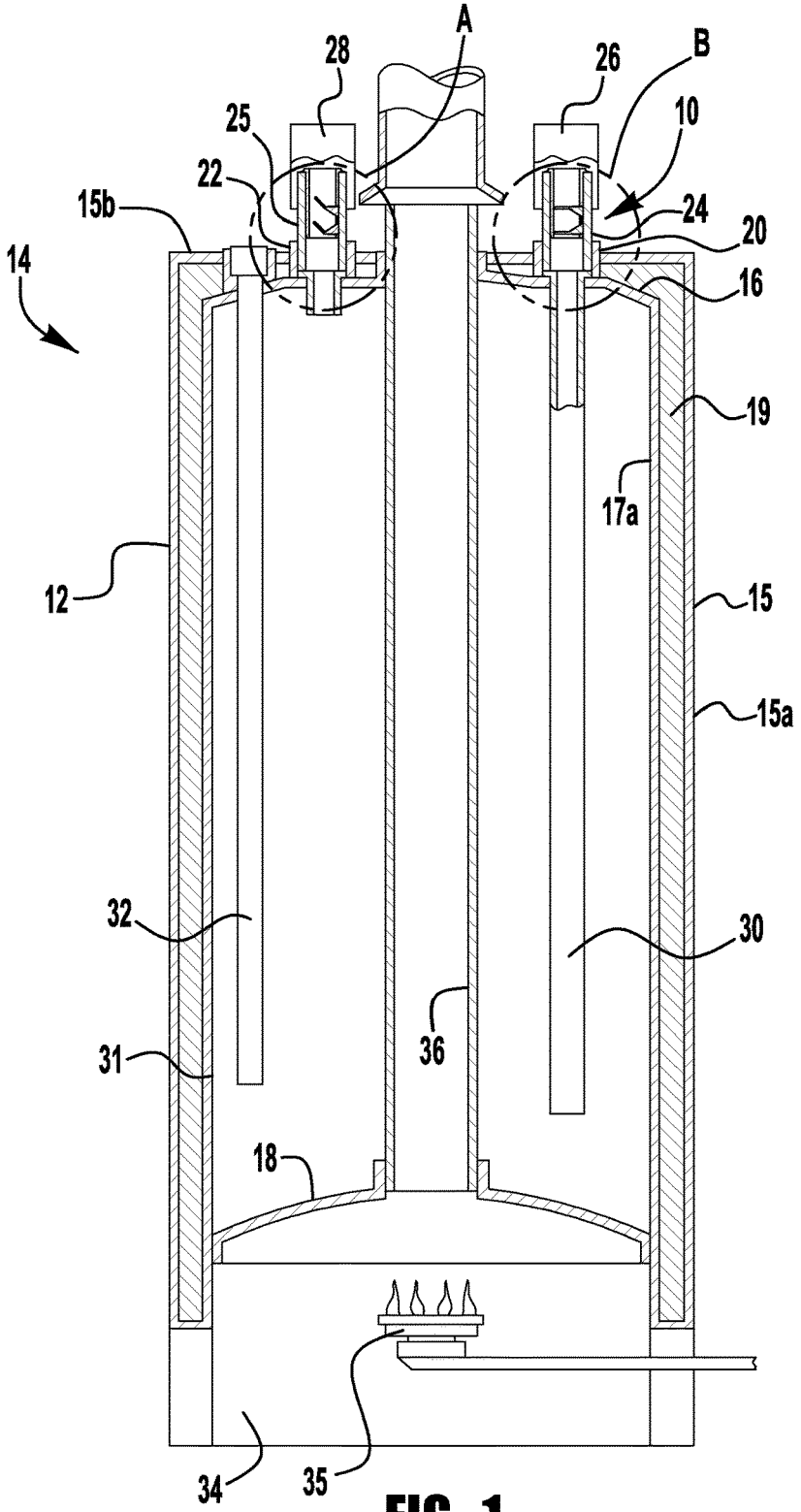
FIG. 1 is a front, cross-sectional view of the water heater system showing hot water flowing through the hot water outlet pipe, in accordance with the present invention.

In the description that follows, numerous details are set forth in order to provide a thorough understanding of the present invention. It will be appreciated by those skilled in the art that variations of these specific details are possible while still achieving the results of the present invention. Well-known processing steps are generally not described in detail in order to avoid unnecessarily obfuscating the description of the present invention.

In the description that follows, exemplary dimensions may be presented for an illustrative embodiment of the invention. The dimensions should not be interpreted as limiting. They are included to provide a sense of proportion. Generally speaking, it is the relationship between various elements, where they are located, their contrasting compositions, and sometimes their relative sizes that is of significance.

In the drawings accompanying the description that follows, often both reference numerals and legends (labels, text descriptions) will be used to identify elements. If legends are provided, they are intended merely as an aid to the reader, and should not in any way be interpreted as limiting.

In normal operation of the water heater, significant heat is lost through the inlet and outlet piping during stand-by periods when the tank is not being actively heated. This heat loss is primarily through thermal convection currents within the water. In other words, heat from the tank transfers in a vertical direction out of the tank within the inlet and outlet piping. Heat traps for hot water storage tanks are known. The traps are mounted at the outlet, and often at the inlet of the tank to minimize convection losses from the tank, when hot water is not being drawn off. Unfortunately, significant heat loss can still occur, despite careful insulation of the water heater tank and pipes. This is because a significant amount of heat loss is attributable to thermal convection currents within the pipes themselves, for example at the tank inlet and outlet ports. These convention currents do not refer to the conduction of water into and/or out of the tank, but rather to heat transfer from hot water in the tank into cooler water at the ports. Thus, even when the water system is in a standby mode (i.e. water is not being introduced to or removed from the tank) a significant amount of heat loss will continuously occur despite the use of external insulation means.

The improved heat trap 10 is designed to provide an improved heat trap of the type that employs a convoluted water channel. The improved heat trap has a minimum of parts with no moving parts. The improved heat trap 10 can be mounted from either of its ends at any location on a water tank 12. The improved heat trap 10, once assembled, cannot be taken apart thus preventing the loss of any parts. The improved heat trap 10 is designed for smooth flow to minimize the trapping of sediment and possible blocking of the trap. The improved trap 10, in one embodiment, is designed to accommodate a dip tube if desired. In another embodiment, the improved heat trap is designed to provide a better seal when mounted in the hot water tank.

FIG. 1 illustrates a three-dimensional, cross-sectional view of a water heater system 14 including a water tank 12. The water tank 12 is comprised of an outer casing 15 having an outer sidewall 15*a* and an outer top wall 15*b* and an inner sidewall 17*a*, an inner top wall 16 and a bottom wall 18. Insulation 19 is disposed between the outer casing 15 and the inner sidewall 17*a* and inner top wall 16. The water tank 12 includes inlet and outlet spuds 20 and 22, respectively, mounted to the top wall 16. Pipe nipples 24 and 25, respectively, thread into the inlet and outlet spuds 20 and 22, respectively, and into inlet and outlet pipes 26 and 28, respectively, for delivery of cold water into and hot water out of water tank 12. The outlet pipe 28 delivers hot water to faucets and other valves when hot water is demanded. The inlet pipe 26 supplies cold water under pressure to the water tank 12. The interior walls of pipe nipples 24 and 25 are 24*a* and 25*a*, respectively.

The water tank 12 includes an inlet tube 30 connecting at one end to the inlet spud 20 and the inlet pipe 26 for the delivery of cold water near the bottom wall 18 of the water tank 12. An anode rod 32 mounted to the outer top wall 15*b* reduces or eliminates the occurrence of corrosion of the interior tank walls 17*a* of water tank 12. A combustion chamber 34 below the bottom wall 18 of water tank 12 includes a burner 35 and a flue 36 that extends upwardly through the tank 12 to vent the products of combustion from the combustion chamber 34. It should be noted that if an electric water heater is utilized, the combustion chamber 34, burner 35, and flue tube 36 would not be included. The water is heated through the bottom wall 18 of the tank 12 and the exhaust gas flows away from the combustion chamber 34 through the flue 36.

Figure 2:
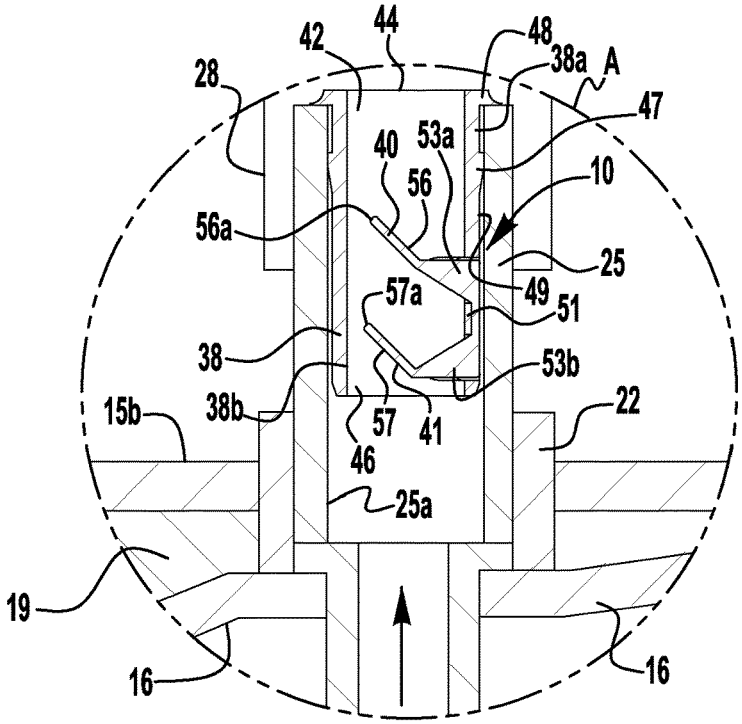
FIG. 2 is an exploded cross sectional view of portion A of FIG. 1 showing of the improved heat trap in use within the pipe nipple during a period of hot water flow through the hot water outlet pipe of the hot water tank, in accordance with the present invention.

As seen in FIGS. 1 and 2, the improved heat trap 10 is designed to be placed within the pipe nipples 24 and 25 that thread into the outlet and inlet spuds 20 and 22, respectively. Referring to FIGS. 2, 2A, 3, 3A, 4 and 5, the heat trap 10 is typically tubular in construction and constructed of a plastic material, with any appropriate dimensions, such as for example an overall height with a range between 0.75 inches and 3.00 inches, an outer diameter with a range between 0.30 inches and about 1.0 inches, and an inner diameter with a range between 0.35 inches and 0.90 inches. The heat trap 10 is composed of a tubular body 38, and a seal element 39 (see FIG. 6), consisting of first and second axially spaced flapper members 40 and 41, which are adjoined with a spine 51. In general terms, the seal element 39 is securely mounted within the tubular body 38, as discussed hereinafter. The first and second flapper members 40 and 41 form a seal against the interior surface 42*a* of the tubular body 38, to prevent heat from escaping through the inlet and outlet spuds 20 and 22 when the water heater system 14 is in a standby condition.

As seen in FIGS. 2, 2A, 3, 3A, 4 and 5, the tubular body 38 has an internal cavity 42 with an interior surface 42*a* with a uniform diameter throughout and an exterior surface 43. The internal cavity 42 of tubular body 38 has a first opening 44 at a first end 38*a* of the body 38, and a second opening 46 at a second end 38*b* of the body 38. An annular lip 48 is disposed adjacent to the first end 38*a* of the body 38 and extends beyond the diameter of the tubular body 38. As seen in FIGS. 2, 2A, 3 and 3A, the annular lip 48 is designed to hold the heat trap 10 within the pipe nipples 24 and 25.

Directly below the annular lip 48 of tubular body 38 is a first body portion 45 with a reduced outer diameter from the diameter of the annular lip. A locking rib 47 is disposed beneath and adjacent the first body portion 45. The outer diameter of the locking rib 47 is larger than the outer diameter of the first body portion 45 to provide aid in the retention of the tubular body 38 within the pipe nipples 24 and 25. Directly below the locking rib 47 is a second body portion 49 with a diameter substantially the same as the diameter of the first body portion 45. It is within the terms of the present invention to provide a beveled section between the locking rib 47 and the second body portion 49.

When the tubular body 38 is inserted into the pipe nipples 24 and 25, the outer diameter of the second body portion 49 is smaller than that of the inner diameters of the inner walls 24*a* and 25*a* of pipe nipples 24 and 25, respectively, so that the tubular body is easily inserted. Then, the locking rib 47 being approximately the same diameter as that of the inner walls 24*a* and 25*a* contacts the inner walls 24*a* and 25*a* and aids in the retention of the tubular body 38 within the pipe nipples 24 and 25. Finally, the first body portion 45 having an outer diameter less than the inner diameters of the inner walls 24*a* and 25*a* moves into the pipe nipples 24 and 25 until the annular lip 48 that is disposed adjacent to the first end 38*a* of the body 38 is seated on the end of the pipe nipples 24 and 25 to secure the tubular body 38 within the pipe nipples 24 and 25.

Figure 4:
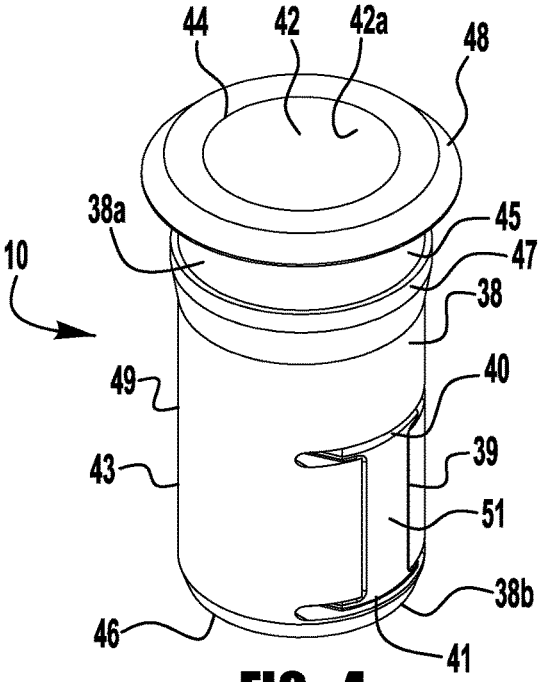
FIG. 4 is a three-dimensional view of the tubular body of the improved heat trap after assembly with a seal element installed, in accordance with the present invention.
Figure 5:
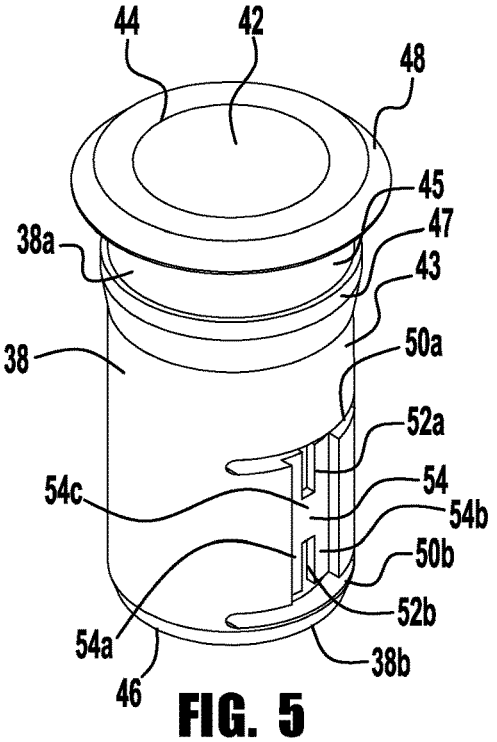
FIG. 5 is a three-dimensional view of the tubular body of the improved heat trap, in accordance with the present invention.
Figure 6:
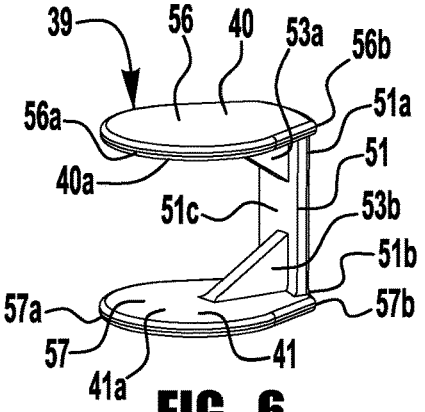
FIG. 6 is a three-dimensional view of the seal element adapted to be installed within the tubular body of the improved heat trap, in accordance with the present invention.

As seen in FIG. 5, the tubular body 38 contains two axially spaced first and second horizontal slots 50*a* and 50*b* extending there through, into which the first and second axially spaced flapper members 40 and 41 of the seal element 39 are inserted, as seen in FIG. 4. Referring to FIG. 6, there are shown first and second vertical slots 52*a* and 52*b* disposed perpendicular to each of the two axially spaced horizontal slots 50*a* and 50*b*, respectively. The first vertical slot 52*a* is perpendicular to and extends directly below first horizontal slot 50*a*, and the second vertical slot 52*b* is perpendicular to and extends directly above second horizontal slot 50*b*. Each horizontal slot 50*a* and 50*b*, and each vertical slot 52*a* and 52*b* extends inwardly through the tubular body 38 and opens to the internal cavity 42 of the tubular body 38.

A vertical portion 54 of tubular body 38 having a length within a range of between 0.40 inches and 0.75 inches and a width of between 0.40 inches and 0.75 inches extends between the two axially spaced horizontal slots 50*a* and 50*b*. Vertical portion 54 is defined as a recessed section which extends from the exterior surface 43 of the tubular body 38 but does not extend to the interior surface 42*a* of the tubular body 38. Note that the vertical slots 52*a* and 52*b*, do extend entirely through the tubular body 38 from the exterior surface 43 to the interior surface 40*a*. The vertical portion 54 has a substantially H shaped form with vertical sidewalls 54*a* and 54*b* extending the length of vertical portion 54 and a connecting section 54*c* disposed between the vertical sidewalls and between the vertical slots 52*a* and 52*b*. The vertical portion 54 is recessed into the tubular body and is designed to accommodate and support the spine 51 which adjoins the first and second axially spaced flapper members 40 and 41, when the flapper members of the seal element 39 are inserted within the two axially spaced horizontal slots 50*a* and 50*b* as shown in FIG. 6 and discussed hereinafter.

As seen in FIG. 6, the seal element 39 is constructed of two, axially spaced flapper members 40 and 41 that are joined by the spine 51. The spine 51 has first and second ends 51*a* and 51*b*. On the interior wall 51*c* of the spine 51, a first triangular insert or gusset 53*a* is braced at the first end 51*a*, between the interior wall 51*c* of the spine and the interior surface 40*a* of the first flapper member 40. Similarly, a second triangular insert or gusset 53*b* is braced at the second end 51*b* of the spine 51, between the wall 51*c* and the interior facing surface 41*a* of the second flapper member 41. The first and second gussets 53*a* and 53*b* are designed to reinforce the seal element 39 and provide a level of rigidity to the structure, which is integral to the improved design. When the seal element 39 is placed within the tubular body 38, the vertical slots 52*a* and 52*b* receive the first and second gussets 53*a* and 53*b*, respectively, therein.

Figure 2A:
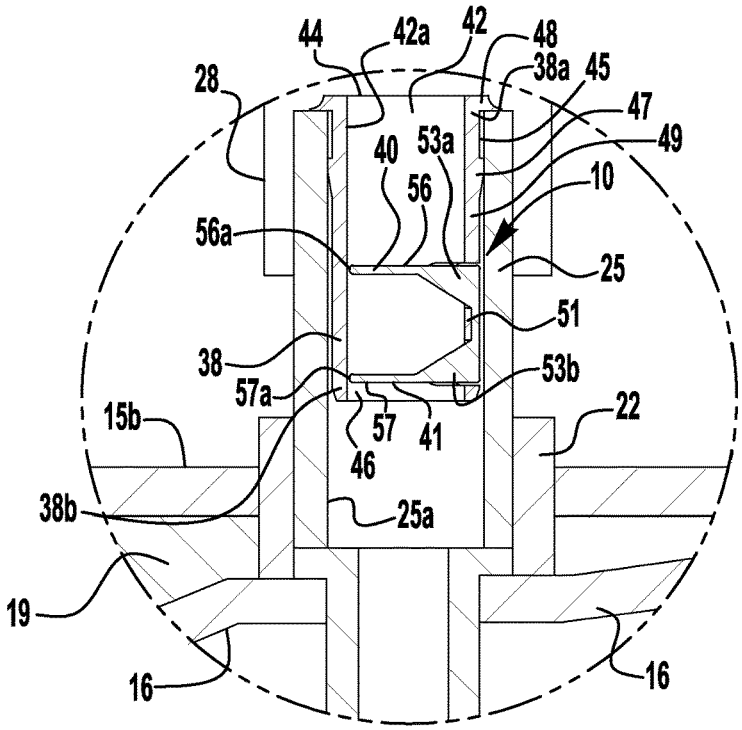
FIG. 2A is an exploded cross sectional view of portion A of FIG. 1 showing the improved heat trap in use within the hot water outlet pipe nipple during a standby period of no hot water flow from the hot water tank, in accordance with the present invention.

The seal element 39 is constructed of a single piece of material capable of withstanding the full range of temperatures associated with standard water heater systems 14. Accordingly, the material used for the seal element 39 must maintain its flexibility and memory through the full range of water temperatures. The seal element 39 is therefore preferably formed from elastomers such as EPDM and other suitable elastomeric materials. The thickness of the flapper members 40 and 41, as well as their circumferential dimension and material, are designed so that the flapper members will readily be moved to the full open position, as shown in FIG. 2, under normal flow rates encountered in a water heater and will have memory to return to their original closed condition, as shown in FIG. 2A, after water flow has ceased.

As seen in FIG. 6, each of the axially spaced flapper members 40 and 41 has a flat configuration, with two outer portions. A first and second generally curved or arcuate outer portion 56 and 57, of the flapper members 40 and 41, respectively, each have a curved edge 56*a* and 57*a*, respectively, that is designed to tightly fit against the interior surface 42*a* of the internal cavity 42 within the tubular body 38, after the seal element 39 has been inserted into the tubular body. After the first and second flapper members 40 and 41 have been inserted through the two axially spaced horizontal slots 50*a* and 50*b*, the curved edges 56*a* and 57*a* of the curved or arcuate outer portions 56 and 57 are pressed against the interior surface 42*a* of the tubular body 38 as shown in FIG. 2A.

When the outer portions 56 and 57 of the first and second flapper members 40 and 41 are in a closed position, i.e. when the water heater 14 is in a standby condition, the amount of heat that transfers from the hot water in the water tank 12 through the hot and cold water piping 24 and 26 is substantially reduced. The flapper members 40 and 41 are biased to the closed position shown in FIG. 2A by the resilient nature of the material, but may be deflected open in either direction as shown in FIG. 2 and described below. When the water heater system 14 is in use, the outer portions 56*a* and 57*a* of the first and second flapper members 40 and 41 are in an open position as shown in FIG. 2. Thus, water may freely flow through inlet and outlet pipes 26 and 28 into and out from the water tank 12.

Each of the axially spaced flapper members 40 and 41 also has a second outer edge portion 56*b* and 57*b* connected to either end 51*a* and 51*b*, respectively, of the spine 51. Each of the second outer edge portion 56*b* and 57*b* are disposed in proximate relation to the corresponding first generally curved or arcuate outer portions 56 and 57, respectively. The spine 51 interconnects the second outer edge portion 56*a* of the first flapper member 40 and with the second outer edge portion 57*b* of the second flapper member 41.

To assemble the improved heat trap 10, the seal element 39 is secured to the tubular body 38. To do so, the first generally curved or arcuate outer portions 56*a* and 57*a* of the first and second axially spaced flapper members 40 and 41 are inserted through the two, axially spaced, horizontal slots 50*a* and 50*b* of the tubular body 38. Thus, the first and second axially spaced flapper members 40 and 410 are disposed at locations circumferentially spaced apart from one another within the internal cavity 42 of tubular body 38.

In the assembled heat trap 10, the spine 51 of the seal element 39 is disposed within the vertical portion 54 between the two axially spaced horizontal slots 50*a* and 50*b* and the first and second gussets 53*a* and 53*b* are received within the vertical slots 52*a* and 52*b* of the tubular body 38.

After assembly, the improved heat trap 10 may be incorporated into the water heater system 14, as seen in FIGS. 1, 2, 2*a*, 3 and 3A. The heat trap 10 can be supported within the inlet and outlet spuds 20 and 22 by the annular lip 48. When the water heating system is in the standby condition, the improved heat trap 10 will close the pipe nipples 24 and 25 to substantially prevent heat loss from the hot water in the water tank 12 through inlet and outlet pipes 26 and 28 by heat convection.

When there is a demand for hot water, hot water is forced out of the water tank 12 through the pipe nipple 25 and into outlet pipe 28 as shown in FIGS. 1 and 2. The hot water flowing through the seal element 39 in pipe nipple 25 will cause the first and second axially spaced flapper members 40 and 41 to pivot upwardly, as shown in FIG. 2, to thereby minimize restriction of hot water flowing from the water tank. When the demand for heated water ceases and flow terminates, the flapper members 40 and 41 will automatically return to their original transverse position to prevent heat convection flow from the hot water tank to the outlet pipe 28.

Figure 3:
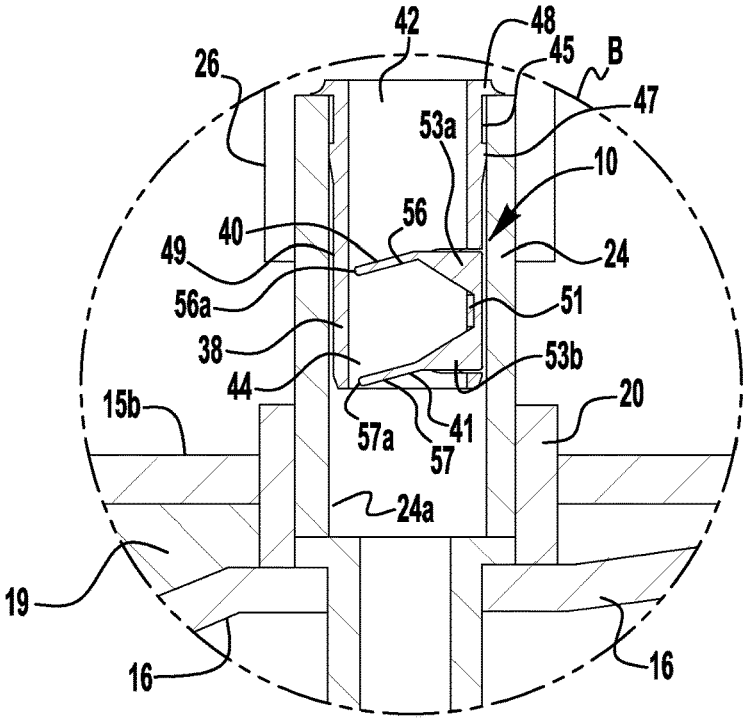
FIG. 3 is an exploded cross sectional view of portion B of FIG. 1 showing of the improved heat trap in use within the pipe nipple during a period of cold water flow through the cold water inlet pipe of the hot water tank, in accordance with the present invention.
Figure 3A:
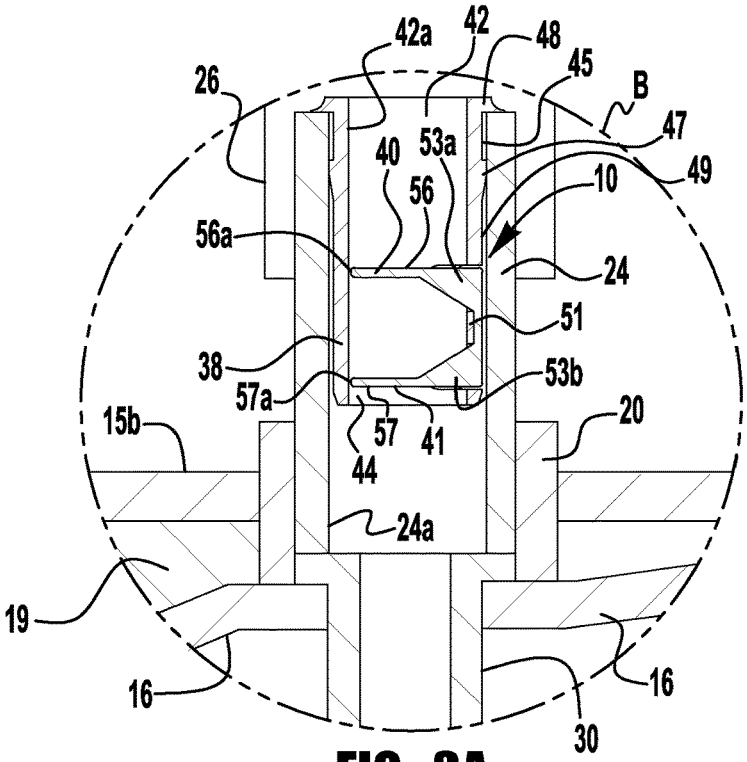
FIG. 3A is an exploded cross sectional view of portion B of FIG. 1 showing the improved heat trap in use within the cold water inlet pipe nipple during a standby period of no cold water flow into the hot water tank, in accordance with the present invention.

Concurrently, cold water is introduced to the tank 12 through the inlet pipe 26, through pipe nipple 24 and inlet tube 30. The flow of cold water deflects the flap portions 40 and 41 of the heat trap 10 in the pipe nipple 24, as shown in FIG. 3, to pivot downwardly (not shown) to minimize restriction of cold flowing into the water tank. When the demand for cold water ceases and flow terminates, the flapper members 40 and 41 will automatically return to their original transverse position, as shown in FIGS. 1 and 3A to prevent heat convection flow from the hot water tank to the inlet pipe 26.

Because the heat trap 10 is designed to permit the flapper members 40 and 41 to deflect in both directions, a heat trap may be used in either or both of the inlet and outlet pipe nipples 24 and 25. Therefore, while the heat trap 10 is shown in both the pipe nipple 25 and the pipe nipple 24, it is within the terms of the present invention to provide the heat trap in only one of the pipe nipples.

Although the invention has been shown and described with respect to a certain preferred embodiment or embodiments, certain equivalent alterations and modifications will occur to others skilled in the art upon the reading and understanding of this specification and the annexed drawings. In particular regard to the various functions performed by the above described components (assemblies, devices, etc.) the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application.

The invention claimed is:

1. An improved heat trap disposed in at least one of an inlet pipe and an outlet pipe for delivery of cold water into and hot water out of a water tank, comprising:

a tubular body having an internal cavity with an interior surface and an exterior surface;

the tubular body having first and second axially spaced, horizontal slots extending through the interior surface and the exterior surface;

the tubular body having a vertical recessed section extending between the first and second axially spaced horizontal slots:

a seal element comprising first and second axially spaced flapper members which are adjoined by a spine and inserted into the first and second axially spaced, horizontal slots;

a first triangular gusset and a second triangular gusset formed on first and second ends, respectively, of the spine;

a first vertical slot disposed perpendicular to and extending directly below the first axially spaced, horizontal slot and a second vertical slot disposed perpendicular to and extending directly above the second axially spaced, horizontal slot, such that the first vertical slot receives the first triangular gusset and the second vertical slot receives the second triangular gusset when the first and second axially spaced flappers are inserted into the first and second axially spaced, horizontal slots and the spine disposed within the vertical recessed section; and the seal element extending through the tubular body whereby the first and second flapper members form a seal against an interior surface of the tubular body to prevent the delivery of water through the tubular body.

2. The improved heat trap of claim 1 wherein the interior surface of the tubular body has a uniform diameter throughout.

3. The improved heat trap of claim 2 wherein the internal cavity of the tubular body has a first opening at a first end of the tubular body, and a second opening at a second end of the tubular body.

4. The improved heat trap of claim 3 wherein the tubular body has an annular lip disposed adjacent to the first end of the tubular body to hold the heat trap within a pipe nipple disposed in at least one of the inlet and outlet pipes.

5. The improved heat trap of claim 1 wherein the first and second vertical slots are disposed perpendicular to each of the first and second axially spaced horizontal slots, respectively, such that the first vertical slot is perpendicular to and extends through the vertical recessed section directly below the first horizontal slot, and the second vertical slot is perpendicular to and extends through the vertical recessed section directly above the second horizontal slot.

6. The improved heat trap of claim 5 whereby the first and second horizontal slots, and the first and second vertical slots extend inwardly through the tubular body and open to the internal cavity of the tubular body.

7. The improved heat trap of claim 1 wherein the first triangular gusset and the second triangular gusset maintain the first and second axially spaced flapper members in a static position when water is not delivered through the tubular body.

8. The improved heat trap of claim 7 wherein:

each of the axially spaced, first and second flapper members has a flat configuration;

each of the first and second flapper members has first and second generally curved outer portions, respectively; and each of the first and second curved outer portions has a curved edge that is adapted to tightly seal against the interior surface of the internal cavity within the tubular body after the seal element has been inserted into the tubular body.

9. The improved heat trap of claim 8 wherein each of the axially spaced, first and second flapper members has an outer edge portion connected to either end, respectively, of the spine, such that each of the outer edge portion of the first and second flapper members are disposed in proximate relation to the corresponding first and second curved outer portions, respectively.

10. The improved heat trap of claim 9 wherein the spine interconnects the second outer edge portion of the first flapper member with the second outer edge portion of the second flapper member.

* * * * *